US009125542B1

(12) United States Patent
Canaanie

(10) Patent No.: US 9,125,542 B1
(45) Date of Patent: Sep. 8, 2015

(54) PORTABLE DISHWASHER CONVEYOR SYSTEM

(71) Applicant: Behzad Canaanie, Pomona, CA (US)

(72) Inventor: Behzad Canaanie, Pomona, CA (US)

( * ) Notice: Subject to any disclaimer, the term of this patent is extended or adjusted under 35 U.S.C. 154(b) by 79 days.

(21) Appl. No.: 13/874,684

(22) Filed: May 1, 2013

(51) Int. Cl.
*A47L 15/24* (2006.01)

(52) U.S. Cl.
CPC ..... *A47L 15/241* (2013.01)

(58) Field of Classification Search
USPC ..... 134/124
See application file for complete search history.

(56) References Cited

U.S. PATENT DOCUMENTS

| | | | | |
|---|---|---|---|---|
| 3,804,104 | A * | 4/1974 | James | 134/72 |
| 3,886,959 | A * | 6/1975 | Stott | 134/134 |
| 4,406,401 | A * | 9/1983 | Nettro | 236/12.12 |
| 5,464,032 | A * | 11/1995 | Litterst | 134/72 |
| 5,507,877 | A | 4/1996 | Magsig et al. | |
| 5,875,883 | A * | 3/1999 | Ertel et al. | 198/821 |
| 6,530,996 | B2 | 3/2003 | Varpio | |
| 7,938,913 | B2 | 5/2011 | Berner et al. | |
| 2002/0153021 | A1 | 10/2002 | Audet | |
| 2004/0094185 | A1 | 5/2004 | Fransson | |
| 2006/0180179 | A1 | 8/2006 | Roderer et al. | |
| 2008/0029131 | A1 * | 2/2008 | Ecker | 134/57 D |
| 2008/0245394 | A1 * | 10/2008 | Doherty et al. | 134/21 |

FOREIGN PATENT DOCUMENTS

| | | | |
|---|---|---|---|
| EP | 2431305 | A1 * | 3/2012 |
| WO | WO 2005022739 | A1 * | 3/2005 |
| WO | WO 2009114348 | A1 * | 9/2009 |

* cited by examiner

*Primary Examiner* — Michael Kornakov
*Assistant Examiner* — Rita Adhlakha

(57) ABSTRACT

A portable dishwasher conveyor system for automatically cleaning dishes features a counter top having a sink. The system features a conveyor frame on the counter top having a continuous conveyor belt on a plurality of rollers. A plurality of drag bars is located on a belt exterior surface. The system features a motor on the conveyor frame for powering the conveyor belt. The system features two "U" shaped spray bars having a plurality of spray bar nozzles and a transparent cover located on the conveyor frame. The system features an adjustable conveyor member located on a frame posterior end that is adapted to angularly adjust to a downward slope for conveying dishes into the sink.

1 Claim, 6 Drawing Sheets

PORTABLE DISHWASHER CONVEYOR SYSTEM

FIELD OF THE INVENTION

The present invention relates to dishwashing systems, or more specifically, dishwashing conveyor systems.

BACKGROUND OF THE INVENTION

Dishwashers have been in use for many years in both home and commercial use, having origins dating to the early 1800s. Dishwashers for home use typically employ a container having one or more strainer baskets for holding the dishes while one or more arms are used to spray wash and rinse solutions on the dishes. Commercial dishwashers may have an alternate design using a linear conveyor system that conveys dishes through a series of spray headers directing high temperature wash and rinse solutions towards the dishes. These conveyor designs typically occupy much more area than a home model, however, deeming them impractical for home use. The present invention features a compact portable dishwasher conveyor system for automatically cleaning dishes.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a portable dishwasher conveyor system for automatically cleaning dishes comprising a horizontal counter top with a sink located therein. In some embodiments, the system comprises a conveyor frame located on the counter top.

In some embodiments, the system comprises a continuous conveyor belt located over a plurality of rollers on the conveyor frame. In some embodiments, a plurality of drag bars is sequentially located on a belt exterior surface. In some embodiments, the system comprises a motor located on the conveyor frame having an externally toothed drive gear located on a rotating motor shaft for powering the conveyor belt.

In some embodiments, the system comprises a pair of "U" shaped spray bars located on the conveyor frame. In some embodiments, the spray bars comprise a plurality of spray bar nozzles located on each spray bar inside surface thereon. In some embodiments, the spray bars are located at a bar angle from one another. In some embodiments, the system comprises a transparent cover located on the conveyor frame. In some embodiments, the system comprises an adjustable conveyor member located on a frame posterior end adapted to angularly adjust to a downward slope for conveying dishes into the sink.

DESCRIPTION OF PREFERRED EMBODIMENTS

Figure 1:
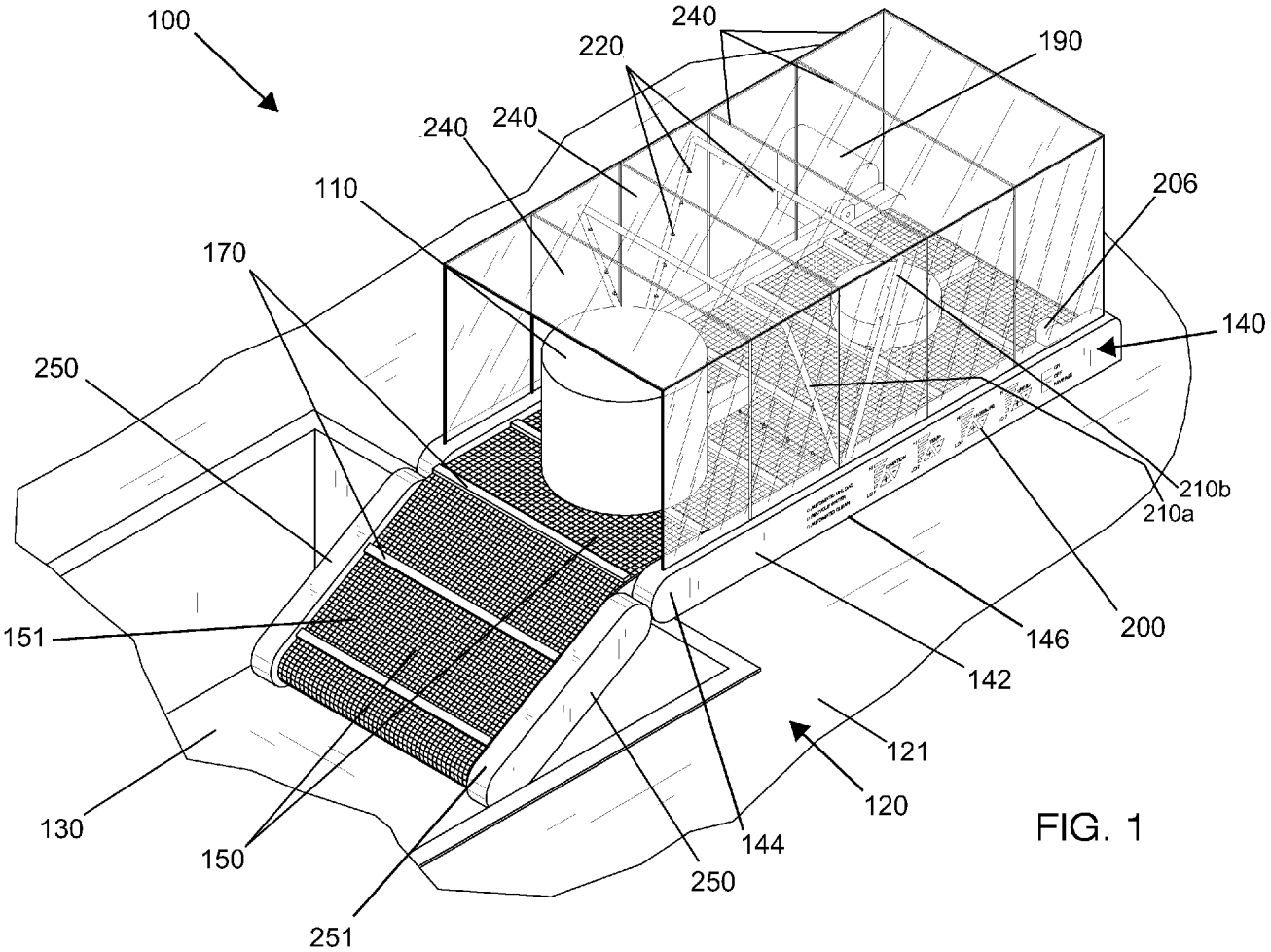
FIG. 1 shows a perspective view of the present invention.
Figure 2:
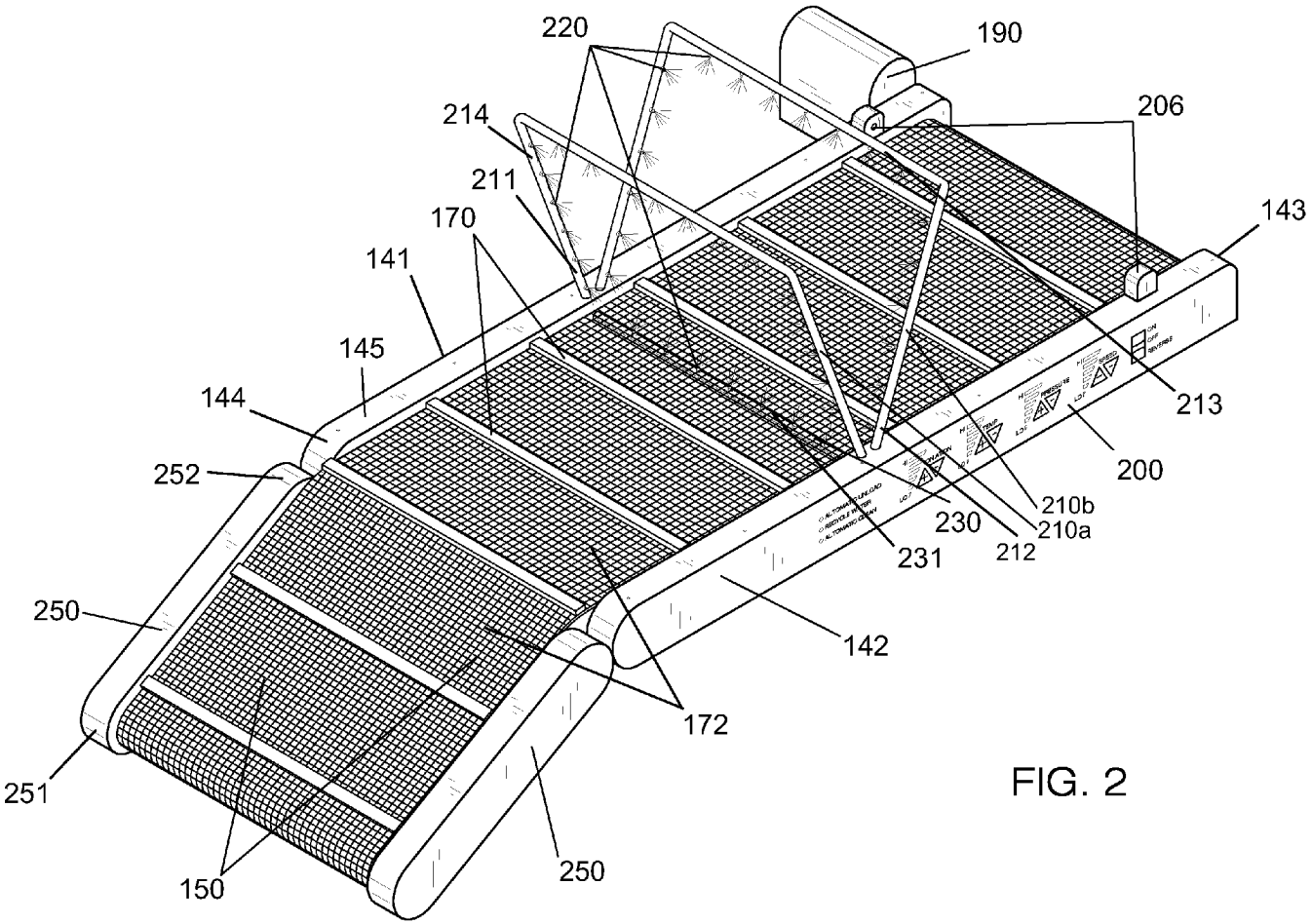
FIG. 2 shows a perspective view of the conveyor frame, the conveyor belt and the spray bars of the present invention.
Figure 3:
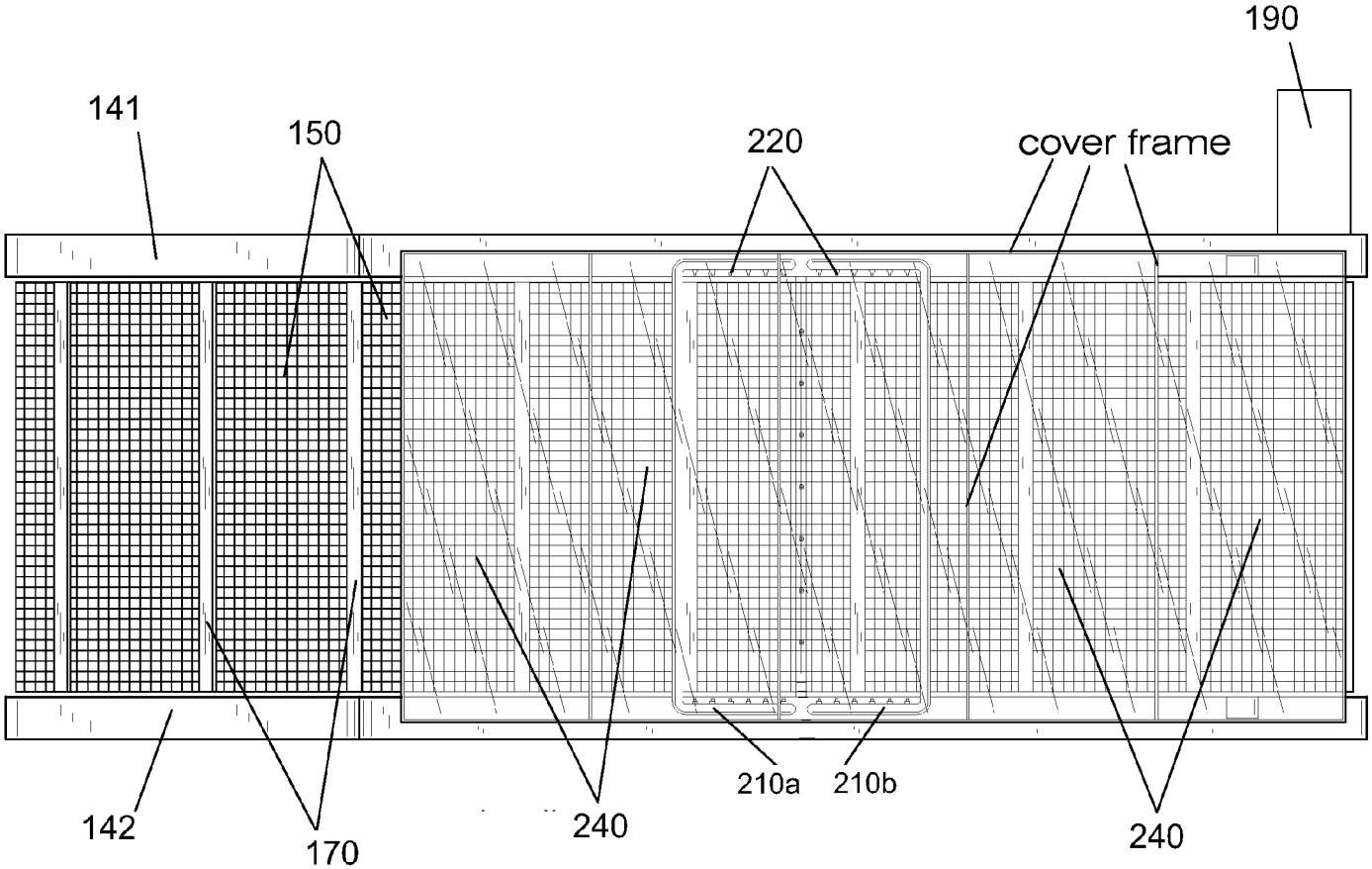
FIG. 3 shows a top view of the present invention.
Figure 4:
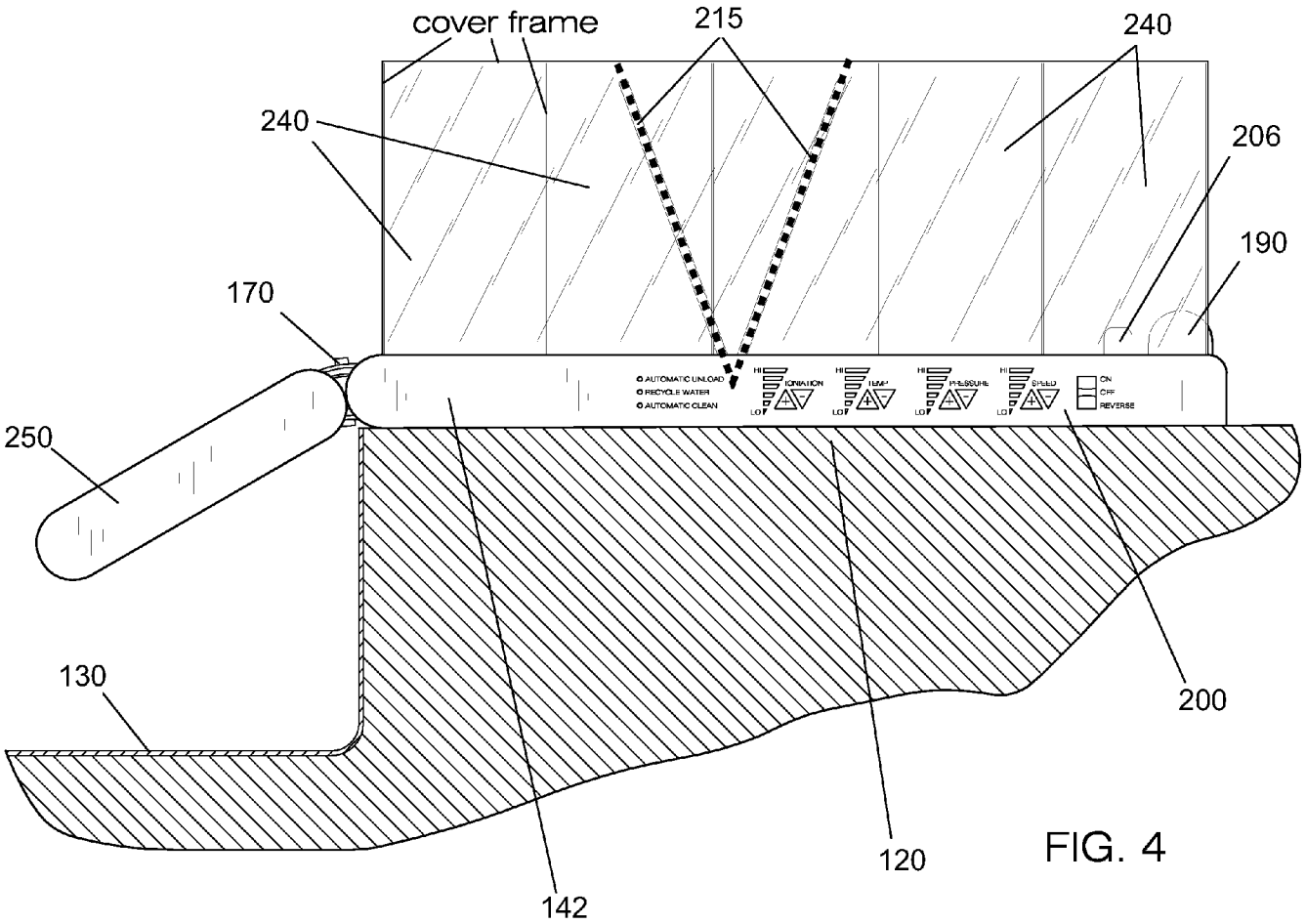
FIG. 4 shows a side view of the present invention.
Figure 5:
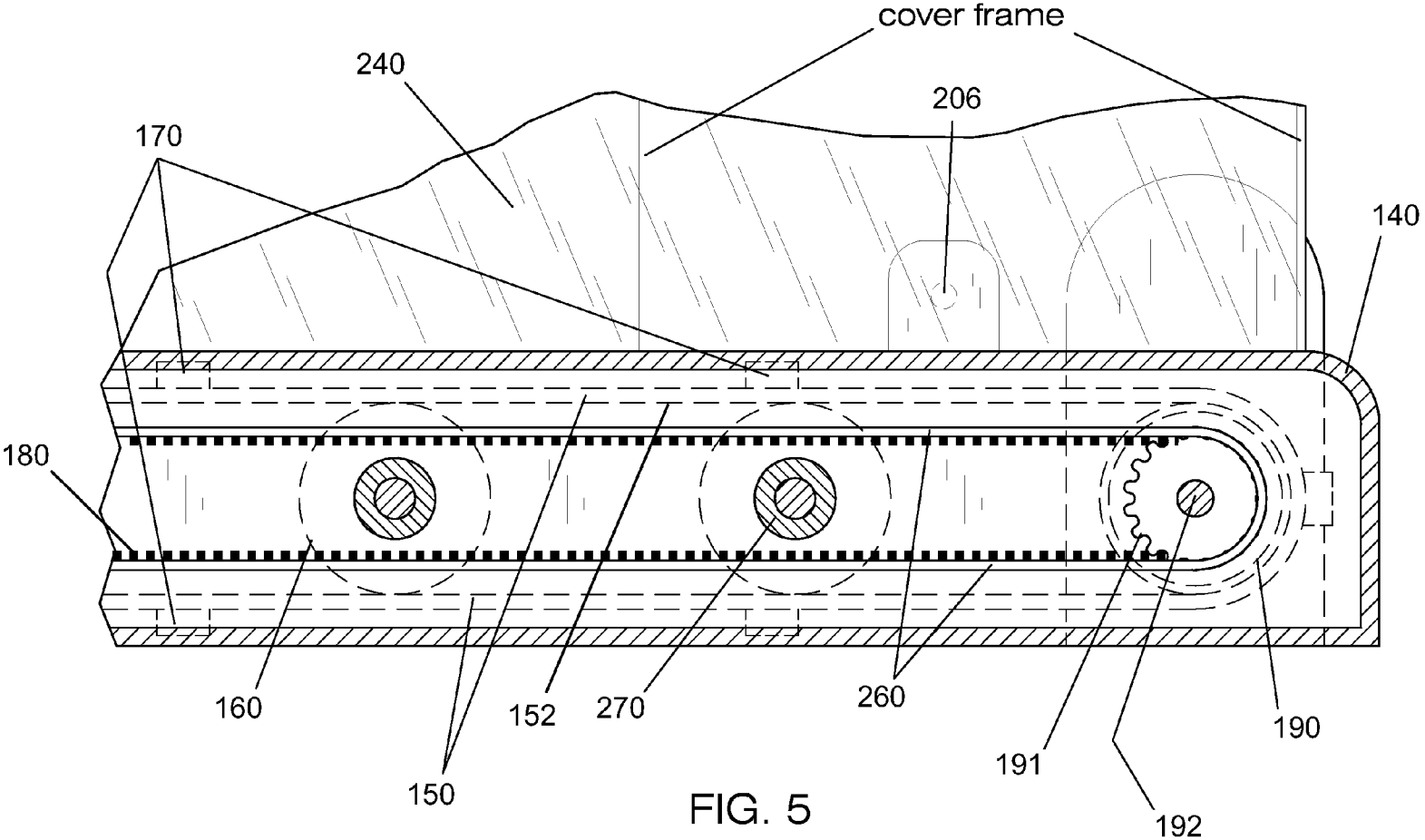
FIG. 5 shows a cross-section in a sagittal plane of a conveyor frame featuring a conveyor belt, a roller, a gear and a motor.
Figure 6:
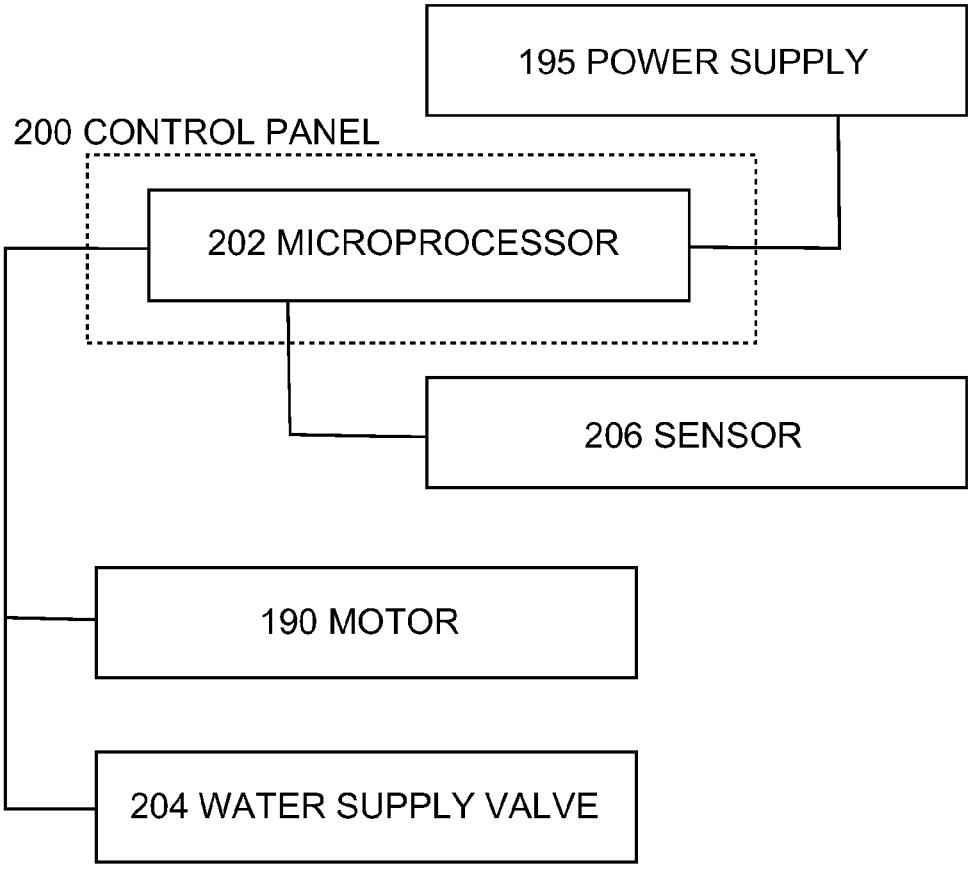
FIG. 6 shows a schematic of the present invention.

Following is a list of elements corresponding to a particular element referred to herein:

100 Portable dishwasher conveyor system
110 Dish
120 Counter top
121 Counter top surface
130 Sink
140 Conveyor frame
141 Frame first side
142 Frame second side
143 Frame anterior end
144 Frame posterior end
145 Frame top surface
146 Frame bottom surface
150 Conveyor belt
151 Belt exterior surface
152 Belt interior surface
160 Roller
170 Drag bar, 172 Drag plates
180 Belt tooth
190 Motor
191 Gear
192 Motor shaft
195 Power supply
200 Control panel
202 Microprocessor
204 Water supply valve
206 Sensor
210*a*, 210*b* First spray bar, Second spray bar
211 Spray bar first end
212 Spray bar second end
213 Spray bar mid section
214 Spray bar inside surface
215 Spray bar angle
220 Spray bar nozzle
230 Linear spray bar
231 Linear spray bar inside surface
240 Transparent cover
250 Adjustable conveyor member
251 Adjustable conveyor member first end
252 Adjustable conveyor member second end
260 Drive Chain
270 Bearing Referring now to FIG. 1-6, the present invention features a portable dishwasher conveyor system (100) for automatically cleaning dishes (110). In some embodiments, the system (100) comprises a horizontal counter top (120) having a sink (130) located therein. In some embodiments, the sink (130) is located below a counter top surface (121).

In some embodiments, the system (100) comprises a conveyor frame (140) located on the counter top (120). In some embodiments, the conveyor frame (140) comprises a frame first side (141), a frame second side (142), a frame anterior end (143), a frame posterior end (144), a frame top surface (145), and a frame bottom surface (146). In some embodiments, the frame posterior end (144) is located close to the sink (130).

In some embodiments, the conveyor frame (140) is about 24 inches in length from the frame anterior end (143) to the frame posterior end (144). In some embodiments, the conveyor frame (140) is less than 24 inches in length from the frame anterior end (143) to the frame posterior end (144). In some embodiments, the conveyor frame (140) is greater than 24 inches in length from the frame anterior end (143) to the frame posterior end (144).

In some embodiments, the conveyor frame (140) is about 12 inches in width from the frame first side (141) to the frame second side (142). In some embodiments, the conveyor frame (140) is less than 12 inches in width from the frame first side (141) to the frame second side (142). In some embodiments, the conveyor frame (140) is greater than 12 inches in width from the frame first side (141) to the frame second side (142).

In some embodiments, the system (100) comprises a perforated, continuous conveyor belt (150) having a belt exterior surface (151) and a belt interior surface (152) located on a plurality of rollers (160). In some embodiments, the plurality of rollers (160) is rotatingly located between the frame first side (141) and the frame second side (142). In some embodiments, a plurality of drag bars (170) is sequentially located on the belt exterior surface (151) for catching the dish and pulling it along. In some embodiments, a plurality of teeth (180) is sequentially located on the belt interior surface (152). In some embodiments, the belt interior surface (152) is smooth.

In some embodiments, the system (100) comprises a motor (190) located on the conveyor frame (140) operatively connected to a power supply (195). In some embodiments, the motor (190) comprises an externally toothed drive gear (191) located on a rotating motor shaft (192) for engaging the teeth (180). In some embodiments, the motor (190) is for powering the conveyor belt (150). In some embodiments, the externally toothed drive gear (191) is for engaging a drive chain (260). In some embodiments, the externally toothed drive gear (191) is for engaging the conveyor belt (150).

In some embodiments, one or more of the rollers (160) comprises an externally toothed gear for engaging the drive chain (260) to drive the roller (160). In some embodiments, the belt interior surface (152) does not comprise a plurality of teeth (180), but is smooth for engaging a smooth outer surface of the rollers (160) to drive the conveyor belt (150). In some embodiments, one or more of the rollers (160) are rotationally disposed on friction reducing bearings (270).

In some embodiments, the system (100) comprises a control panel (200) operatively connected to the power supply (195), a microprocessor (202), the motor (190), a water supply valve (204), and one or more sensors (206) located on the frame first side (141) or the frame second side (142). In some embodiments, the control panel (200) comprises one or more buttons, knobs (or other control means) as well as status indicating lights.

In some embodiments, the system (100) comprises a tubular "U" shaped spray bar (210) located on the conveyor frame (140) having a spray bar first end (211) located on the frame first side (141) and a spray bar second end (212) located on the frame second side (142). In some embodiments, the spray bar (210) is fluidly connected to a water supply via the water supply valve (204). In some embodiments, the spray bar (210) comprises a plurality of spray bar nozzles (220) located on a spray bar inside surface (214). In some embodiments, the spray bar (210) is located at a spray bar angle (215) with respect to the frame first side (141) and the frame second side (142). In some embodiments, a spray bar mid section (213) is located at an offset parallel to the belt exterior surface (151). In some embodiments, the spray bar (210) sprays a liquid through the spray bar nozzles (220) onto the dish (110).

In some embodiments, the system (100) comprises a first tubular "U" shaped spray bar (210*a*) located on the conveyor frame (140) having a first spray bar first end (211) located on the frame first side (141) and a first spray bar second end (212) located on the frame second side (142). In some embodiments, a second tubular "U" shaped spray bar (210*b*) is located on the conveyor frame (140) having a second spray bar first end (211) located on the frame first side (141) and a second spray bar second end (212) located on the frame second side (142). In some embodiments, the first spray bar (210*a*) and the second spray bar (210*b*) are fluidly connected to a water supply via the water supply valve (204). In some embodiments, the first spray bar (210*a*) and the second spray bar (210*b*) each comprise a plurality of spray bar nozzles (220) located on a spray bar inside surface (214). In some embodiments, the first spray bar (210*a*) is located at a spray bar angle (215) with respect to the second spray bar (210*b*). In some embodiments, the spray bar angle is 15 degrees or less. In some embodiments, the spray bar angle is 30 degrees. In some embodiments, the spray bar angle is 45 degrees. In some embodiments, the spray bar angle is 60 degrees. In some embodiments, the spray bar angle is 75 degrees. In some embodiments, the spray bar angle is 90 degrees or more.

In some embodiments, a spray bar mid section (213) of each of the first spray bar (210*a*) and the second spray bar (210*b*) is located at an offset parallel to the belt exterior surface (151). In some embodiments, the first spray bar (210*a*) and the second spray bar (210*b*) spray a liquid through the spray bar nozzles (220) onto the dish (110). In some embodiments, the first spray bar (210*a*) and the second spray bar (210*b*) are located on the conveyor frame (140) proximal one to another. In some embodiments, the first spray bar (210*a*) and the second spray bar (210*b*) together comprise a side profile resembling a "V" when viewed from the frame first side (141) or the frame second side (142).

In some embodiments, the system (100) comprises a tubular linear spray bar (230) perpendicularly located between the frame first side (141) and the frame second side (142). In some embodiments, the linear spray bar is located between the frame top surface (145) and the frame bottom surface (146). In some embodiments, the linear spray bar (230) is fluidly connected to the water supply via the water supply valve (204). In some embodiments, the linear spray bar (230) comprises a plurality of spray bar nozzles (220) located on a linear spray bar inside surface (231). In some embodiments, the linear spray bar (230) sprays a liquid through the spray bar nozzles (220) through the perforated conveyor belt (150) onto the dish (110).

In some embodiments, the system (100) comprises a transparent cover (240) located on the conveyor frame (140). In some embodiments, the transparent cover (240) comprises a frame. In some embodiments, along with the conveyor frame (140) a channel is formed through which the dishes (110) pass through. In some embodiments, the transparent cover (240) comprises a shape of a "U" in a coronal plane.

In some embodiments, the system (100) comprises a planar adjustable conveyor member (250) having an adjustable conveyor member second end (252) pivotally located on the frame posterior end (144). In some embodiments, an adjustable conveyor member first end (251) is located adjacent to the sink (130). In some embodiments, an adjustable conveyor member first end (251) is located over the sink (130). In some embodiments, the conveyor belt (150) is located over both the plurality of rollers (160) located on the conveyor frame (140) and a plurality of rollers (160) located on the adjustable conveyor member (250).

In some embodiments, the adjustable conveyor member (250) is adapted to angularly adjust to a downward slope for conveying dishes (110) into the sink (130). In some embodiments, the downward slope is 15 degrees. In some embodiments, the downward slope is 30 degrees. In some embodiments, the downward slope is 45 degrees. In some embodiments, the downward slope is 60 degrees. In some embodiments, the downward slope is 75 degrees. In some embodiments, the downward slope is 15 degrees.

In some embodiments, a dish (110) is placed on the belt exterior surface (151). In some embodiments, the sensor (206) detects the dish (110) and initiates operation of the conveyor belt (150) via the microprocessor (202), and the motor (190). In some embodiments, the dish (110) is conveyed underneath the spray bars (210) and above the linear spray bar (230) for washing. In some embodiments, the dish (110) is lowered to the sink (130) via the adjustable conveyor member (250) and the conveyor belt (150).

In some embodiments, the system (100) comprises a plurality of spray bars located on the conveyor frame (140).

In some embodiments, the system (100) comprises two spray bars (210) located on the conveyor frame (140) close one to another. In some embodiments, the two spray bars (210) together comprise a side profile resembling a "V" when viewed from the frame first side (141) or the frame second side (142).

In some embodiments, the conveyor belt (150) comprises a plurality of lattice patterned drag plates (172) located on the belt exterior surface (151) between each of the plurality of drag bars (170).

As used herein, the term "about" refers to plus or minus 10% of the referenced number.

The disclosures of the following U.S. patents are incorporated in their entirety by reference herein: U.S. Patent Pub. No. 2006/0180179; U.S. Patent Pub. No. 2004/0094185; U.S. Patent Pub. No. 2002/0153021; U.S. Pat. No. 7,938,913; U.S. Pat. No. 6,530,996; and U.S. Pat. No. 5,507,877.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures.

The reference numbers recited in the below claims are solely for ease of examination of this patent application, and are exemplary, and are not intended in any way to limit the scope of the claims to the particular features having the corresponding reference numbers in the drawings.

What is claimed is:

1. A portable dishwasher conveyor system (100) for automatically cleaning dishes (110), the system (100) consisting of:

(a) a horizontal counter top (120) having a sink (130) disposed therein, wherein the sink (130) is disposed below a counter top surface (121);

(b) a conveyor frame (140) disposed on the counter top (120), wherein the conveyor frame (140) consists of a frame first side (141), a frame second side (142), a frame anterior end (143), a frame posterior end (144), a frame top surface (145), and a frame bottom surface (146);

(c) a perforated, continuous conveyor belt (150) having a belt exterior surface (151) and a belt interior surface (152) disposed on a plurality of rollers (160), wherein the plurality of rollers (160) is rotatingly disposed between the frame first side (141) and the frame second side (142), wherein a plurality of drag bars (170) is sequentially disposed on the belt exterior surface (151), wherein the drag bars (170) are disposed across the belt exterior surface (151) such that the drag bars (170) are perpendicular to the frame first side (141) or frame second side (142), wherein each drag bar (170) juts out and away from the belt exterior surface (151);

(d) a motor (190) disposed on the conveyor frame (140) operatively connected to a power supply (195), wherein the motor (190) consists of an externally toothed drive gear (191) disposed on a rotating motor shaft (192) for powering the conveyor belt (150);

(e) a control panel (200) operatively connected to the power supply (195), a microprocessor (202), the motor (190), a water supply valve (204), and one or more sensors (206) disposed on the frame first side (141) or the frame second side (142);

(f) a first tubular "U" shaped spray bar (210*a*) disposed on the conveyor frame (140) having a first spray bar first end (211) disposed on the frame first side (141) and a first spray bar second end (212) disposed on the frame second side (142), wherein a second tubular "U" shaped spray bar (210*b*) is disposed on the conveyor frame (140) having a second spray bar first end (211) disposed on the frame first side (141) and a second spray bar second end (212) disposed on the frame second side (142), wherein the first spray bar (210*a*) and the second spray bar (210*b*) are fluidly connected to a water supply via the water supply valve (204), wherein the first spray bar (210*a*) and the second spray bar (210*b*) each consists of a plurality of spray bar nozzles (220) disposed on a spray bar inside surface (214) beginning at the spray bar first end (211) to a spray bar mid section (213) and ending at the spray bar second end (212), wherein the first spray bar (210*a*) is disposed at a spray bar angle (215) with respect to the second spray bar (210*b*), wherein the spray bar mid section (213) of each of the first spray bar (210*a*) and the second spray bar (210*b*) is disposed at an offset parallel to the belt exterior surface (151), wherein the first spray bar (210*a*) and the second spray bar (210*b*) spray a liquid through the spray bar nozzles (220) onto the dish (110), wherein the first spray bar (210*a*) and the second spray bar (210*b*) are disposed on the conveyor frame (140) adjacent one to another, wherein the first spray bar (210*a*) and the second spray bar (210*b*) together form a side profile resembling a "V" when viewed from the frame first side (141) or the frame second side (142);

(g) a tubular linear spray bar (230) perpendicularly disposed between the frame first side (141) and the frame second side (142), wherein the linear spray bar is disposed between the frame top surface (145) and the frame bottom surface (146), wherein the linear spray bar (230) is fluidly connected to the water supply via the water supply valve (204), wherein the linear spray bar (230) consists of a plurality of spray bar nozzles (220) disposed on a linear spray bar inside surface (231), wherein the linear spray bar (230) sprays a liquid through the spray bar nozzles (220) through the perforated conveyor belt (150) onto the dish (110);

(h) a transparent cover (240) disposed on the conveyor frame (140), wherein along with the conveyor frame (140) a channel is formed through which the dishes (110) pass through, wherein the transparent cover (240) forms a shape of a "U" in a coronal plane; and (i) a planar adjustable conveyor member (250) having an adjustable conveyor member second end (252) pivotally disposed on the frame posterior end (144), wherein an adjustable conveyor member first end (251) is disposed adjacent to the sink (130), wherein the conveyor belt (150) is disposed over both the plurality of rollers (160) disposed on the conveyor frame (140) and a plurality of rollers (160) disposed on the adjustable conveyor member (250);

wherein the adjustable conveyor member (250) is adapted to angularly adjust to a downward slope for conveying dishes (110) into the sink (130);

wherein a dish (110) is placed on the belt exterior surface (151), wherein the sensor (206) detects the dish (110) and initiates operation of the conveyor belt (150) via the microprocessor (202) and the motor (190), wherein the dish (110) is conveyed underneath the spray bars (210*a,b*) and above the linear spray bar (230) for washing, wherein the dish (110) is lowered to the sink (130) via the adjustable conveyor member (250) and the conveyor belt (150).

* * * * *